US006170163B1

(12) United States Patent
Bordignon et al.

(10) Patent No.: US 6,170,163 B1
(45) Date of Patent: Jan. 9, 2001

(54) METHOD OF ASSEMBLING COMPONENTS OF AN ASSEMBLY USING A LASER IMAGE SYSTEM

(75) Inventors: Robert A. Bordignon, Waterloo; Richard M. Bordignon, Conestogo, both of (CA)

(73) Assignee: Virtek Vision Corporation, Waterloo (CA)

( * ) Notice: Under 35 U.S.C. 154(b), the term of this patent shall be extended for 0 days.

(21) Appl. No.: 09/014,019

(22) Filed: Jan. 27, 1998

Related U.S. Application Data

(60) Provisional application No. 60/040,663, filed on Feb. 11, 1997.

(51) Int. Cl.[7] ..... B43L 13/20

(52) U.S. Cl. ..... 33/16; 33/228; 33/DIG. 21; 33/613; 269/910; 269/37; 29/559; 29/281.3

(58) Field of Search ..... 33/16, 613, 228, 33/286, 545, 546, 547, 549, 551, DIG. 21; 269/910, 37; 29/281.3, 559

(56) References Cited

U.S. PATENT DOCUMENTS

| | | | | |
|---|---|---|---|---|
| 2,607,267 | * | 8/1952 | Fultz et al. | 33/547 |
| 3,603,244 | | 9/1971 | Jureit et al. | 100/48 |
| 3,603,688 | * | 9/1971 | Smith-Vaniz | 33/DIG. 21 |
| 3,826,188 | | 7/1974 | Erberle | 100/100 |
| 3,896,717 | | 7/1975 | Schmitt | 100/100 |
| 3,939,764 | | 2/1976 | McCormack | 100/100 |
| 4,111,114 | | 9/1978 | Carr | 100/100 |
| 4,901,359 | | 2/1990 | Bruder | 382/8 |
| 4,936,020 | * | 6/1990 | Neblett | 33/1 G |
| 4,941,183 | | 7/1990 | Bruder et al. | 382/8 |
| 4,943,038 | * | 7/1990 | Harnden | 269/910 |
| 5,085,414 | * | 2/1992 | Weaver | 269/910 |
| 5,258,917 | | 11/1993 | Bruder et al. . | |
| 5,342,030 | | 8/1994 | Taylor | 269/37 |
| 5,385,339 | | 1/1995 | Williams | 269/37 |
| 5,388,318 | * | 2/1995 | Petta | 29/407 |
| 5,553,375 | | 9/1996 | Powers | 29/798 |
| 5,608,970 | * | 3/1997 | Owen | 29/281.3 |
| 5,646,859 | * | 7/1997 | Petta et al. | 29/897.312 |
| 5,702,095 | * | 12/1997 | Williams | 29/281.3 |
| 5,854,747 | * | 12/1998 | Fairlie | 269/910 |

* cited by examiner

*Primary Examiner*—Diego Gutierrez
*Assistant Examiner*—Maria Fernandez
(74) *Attorney, Agent, or Firm*—Howard & Howard

(57) ABSTRACT

A method of assembling components of an assembly, such as the components of a truss, using a laser imaging system in combination with assembly jigs. The jigs may be slidably mounted on an assembly table wherein the jigs include laser alignment indicia on a top surface of the jigs spaced a predetermined distance from a side surface of the jigs. The method includes projecting an enlarged laser generated outline of at least a portion of the components to be assembled which is spaced laterally from an outline or template of the components in the assembled position a distance equal to the distance between the laser alignment indicia and the side surface of the jigs and spaced vertically a distance equal to the distance between the indicia and the work surface. The jigs are then moved on the work surface to align the laser alignment indicia with the enlarged outline and affixed relative to the work surface. Finally, the components are assembled on the work surface in generally abutting relation with the side surfaces of the jigs and assembled. Where the assembly method of this invention is used for assembling trusses, the laser generated outline may be used to orient the truss planks.

12 Claims, 3 Drawing Sheets

METHOD OF ASSEMBLING COMPONENTS OF AN ASSEMBLY USING A LASER IMAGE SYSTEM

This Application claim benefit to Provisional Application 60/040,663 Feb. 11, 1997.

The present invention relates to a method of assembling the components of an assembly on a work surface using a laser imaging system. More specifically, the present invention relates to a method of assembling components of an assembly, such as the components of a truss, in a predetermined location and orientation on a work surface having a plurality of assembly jigs mounted for movement on the work surface, wherein the laser image is used to orient the jigs for assembly of the components on the work surface.

BACKGROUND OF THE INVENTION

Laser imaging systems have been used for some years to assemble the components of an assembly, such as the components of a truss or the components of an aircraft assembly. The laser imaging system generally includes a computer or controller, a laser scanner projector and a data set defining the pattern of the components of the assembly in the desired orientation and pattern. The laser scanner includes a laser which is projected on mirrors rotatably mounted in parallel perpendicular relation. The rapidly scanning laser image is a laser spot which moves from location to location with sufficient speed to appear to the assembly person as a continuous line. A plurality of images may be projected essentially simultaneously for assembly of a plurality of components, such as the planks and/or the truss connector plates on a flat work surface or the components of an aircraft on a three-dimensional work surface. Such laser assembly systems are available from Virtek Vision Corp., the assignee of the present invention.

It is also common to assemble components using jigs mounted on a work surface, particularly repeated assembly of components in a predetermined pattern or orientation. In assembly of a truss, for example, it is common to mount jigs on a table which in combination define the location and orientation of the components of a particular truss generally for repeated assembly of a truss design. As will be understood by those skilled in the art, trusses are used for roof and floor supports of domestic and commercial buildings. The truss comprises a plurality of elongated planks generally made of wood, steel or other materials arranged in a triangulated pattern which are interconnected by truss connector plates having transverse sharp tangs which are driven into the adjacent planks at the points of intersection or other connection methods. The planks are pre-cut to a predetermined length and angle, and the planks are arranged on the work surface in a predetermined orientation and triangulated pattern for interconnection by the truss connector plates or other fasteners for each truss design. Set-up jigs have been used for many years to facilitate the assembly of trusses having a common design.

Truss assembly tables having pre-mounted moveable jigs or "pucks" are also commercially available. In such truss assembly tables, the work surface includes a plurality of spaced parallel guides and the jigs are slidably mounted on the guides for parallel movement on the work surface. Truss assembly jig tables are also available wherein the jigs are magnetically held to the work table or wherein the jigs include an elongated slot which receives a fastener on the table, permitting orientation of the jigs on the table. Following orientation of the jigs on the work surface, the jigs are fixed relative to the work surface for assembly of a particular truss design. In one preferred embodiment of a truss assembly table, the work surface includes a plurality of spaced parallel channels and the jigs each include a portion which is received in the channel for parallel movement on the work surface.

The assembly of a truss on a jig set-up table of this type then includes moving a plurality of jigs generally in parallel relation on the guides to a predetermined position on the work surface and fixing the jigs relative to the work surface for assembly of a truss design. In the alternative designs of truss jig assembly tables discussed above, the jigs are moved in any direction to the predetermined location and fixed relative to the table. This method, however, remains a time consuming procedure because the location of each of the jigs must be very accurately measured relative to a reference point or line, such as the end of the work table. Further, it is easy to miscalculate the precise predetermined location of one or more jigs, particularly for a large complex truss. Where the error is not immediately determined, the truss may be improperly assembled even where the error is only a fraction of an inch because the errors may be cumulative. Further, the location and orientation of the components of a large complex truss, for example, may not be apparent from the location of the jigs, requiring skilled labor. Thus, such jig set-up tables are generally only used where a substantial number of trusses of the same design are assembled. It would be desirable, however, to use such jig set-up tables even where a limited number of trusses of the same design are assembled. Further, it would be very desirable to reduce the set-up time and improve the accuracy of a jig assembly table of this type and simplify the assembly. Thus, the primary objects of the present invention are to accomplish these purposes by combining the advantages of a laser layout assembly system and jig assembly table.

SUMMARY OF THE INVENTION

The method of assembly of this invention combines the advantages of a laser template assembly system and an adjustable jig set-up table resulting in reduced set-up time and improved accuracy. Further, the method of assembly of this invention may be used by relative unskilled technicians without requiring accurate measurement of the proper location of each of the jigs. All of the jigs are very accurately located by the laser image using the method of assembly of this invention, without measurement. The method of assembly of this invention further reduces the time required for set-up of the jigs and reduces the costs of a truss jig set-up table by eliminating the requirement for scales on the work surface or guides or sight windows on the jigs.

As described, the method of assembling components of an assembly on a work surface of this invention utilizes a laser imaging system and a plurality of jigs which are moveable on the work surface and fixable relative to the work surface to accurately define in combination the relative positions of the assembled components. Although the method of this invention may utilize an assembly jig set-up table of the types described above, the method of this invention is not limited to the design of the set-up table. The jigs preferably each include laser alignment indicia on a top surface spaced above the work surface wherein the indicia is spaced a predetermined distance from a side surface of the jig, which in combination define the relative positions of the components of the assembly as described.

The method of this invention then includes projecting a laser image on the work surface which includes an enlarged outline of at least a portion of the components of the assembly in the desired predetermined location and orientation. The enlarged laser image is spaced laterally from an outline of the components a distance equal to the predetermined distance from the indicia on the top surface of the jigs to the side surface and spaced vertically from the work surface a distance equal to the distance between the work surface and the top surface of the jigs. The method of this invention then includes moving a plurality of jigs on the work surface to align the indicia on the jigs with the laser image enlarged outline and fixing the jigs relative to the work surface, wherein the side surfaces of the jigs in combination define an outline of the components of the assembly in their predetermined locations. Finally, the method of this invention includes placing the components of the assembly on the work surface generally abutting the side surfaces of the jigs and assembling the components of the assembly.

In a preferred method of this invention utilizing a jig set-up table of the type described, the work surface preferably includes a plurality of spaced guides and the jigs are mounted on the guides for movement on the work surface. As described, the top surface of each of the jigs include an indicia for alignment of the jigs with the laser image outline. For example, the indicia may comprise crossed-scribes marking the center of a generally cylindrical jig or "puck", a point, straight edge or a tangent of a cylindrical edge, provided the indicia is spaced a predetermined distance from the side surface of the jig for accurate alignment of the jigs on the work surface. The method then includes projecting a laser image on the work surface of an enlarged outline of at least a portion of the components of the assembly which crosses the linear guides. Where a truss is assembled on the work surface using the method of this invention, the truss generally comprises a plurality of planks which are arranged in triangulated patterns which cross the linear guides. The method then includes moving the jigs to align the indicia on the top surface of the jigs with the linear pattern or enlarged laser outline generated by the laser imaging system. The jigs are then fixed relative to the work surface, such that a line drawn between the side surfaces of the jigs define an outline of the components of the assembly. The method then includes placing the components of the assembly on the work surface with the side surfaces of the components abutting the side surface of the jigs and the components are then assembled as described. In the most preferred method of assembling a truss, for example, the laser image may comprise an enlarged outline of a portion of the boards, such that the jigs locate the boards in the desired location and orientation of the truss design. Alternatively, the method of this invention may be utilized to project an enlarged outline of the truss connector plates or portions of both the truss connector plates and the boards may be projected for assembly, as described.

As will now be understood, the method of assembly of this invention may be utilized to quickly and accurately position jigs on an assembly table or other work surface without requiring measurement of the location of the jigs. Further, the requirement for rulers or linear scales or indexed rails on the assembly table are eliminated and the jigs may be simple and inexpensive in construction. Although the invention will now be described in relation to the assembly of trusses utilizing a jig set-up table, it will be understood that the method of assembly of this invention may also be utilized to assembly components of many different types of assemblies in two or three dimensions, as described. Other advantages and meritorious features of the method of assembly of this invention will be more fully understood from the following description of the preferred embodiments of the method of this invention, the appended claims and the drawings, a brief description of which follows.

DETAILED DESCRIPTION OF THE PREFERRED EMBODIMENTS OF THE METHOD OF THIS INVENTION

Figure 1:
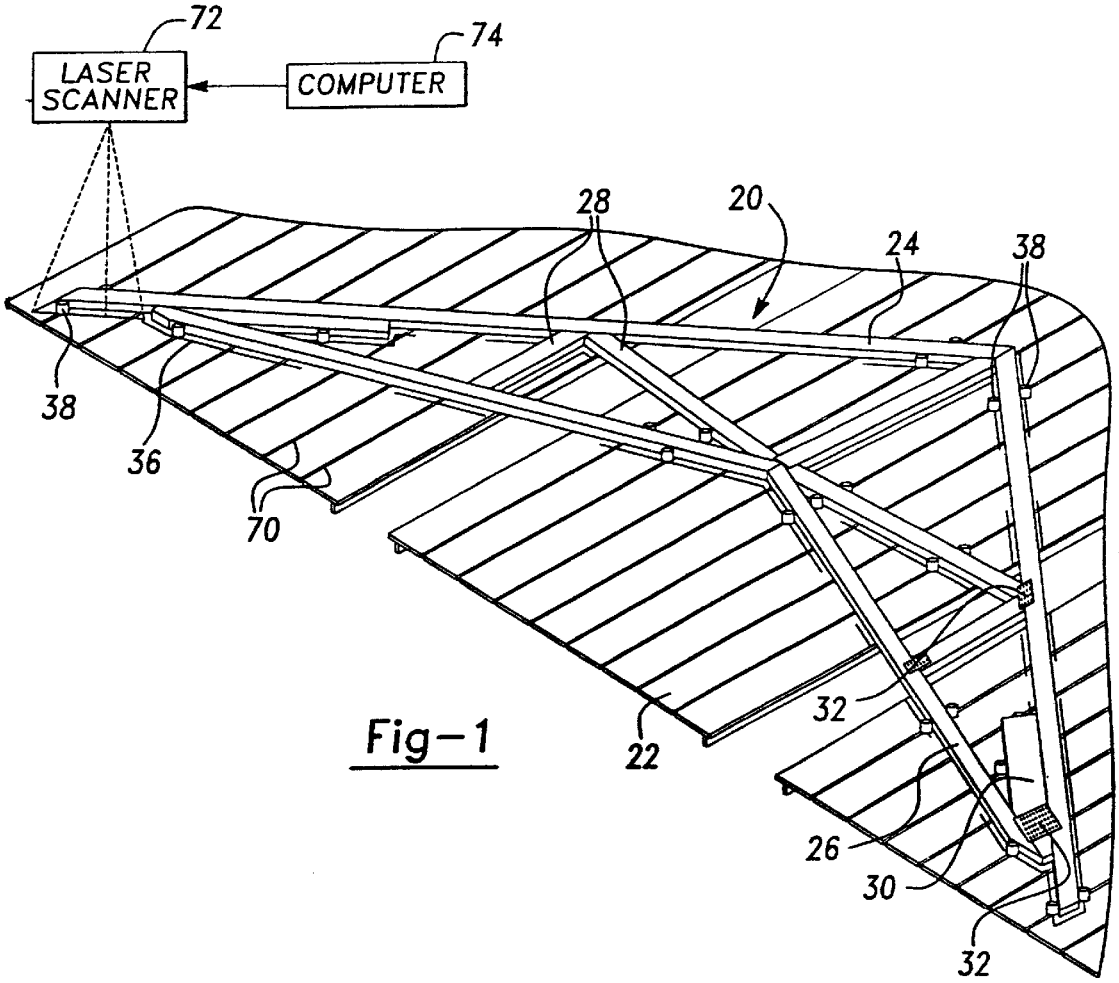
FIG. 1 is a top perspective view of a truss assembly assembled by the method of this invention.

As described above, the method of assembly of this invention may be utilized to assemble various components of an assembly including but not limited to the components of a truss. FIG. 1 illustrates a relatively simple roof truss 20 being assembled on a truss assembly table 22 by the method of this invention. A roof truss 20 of the type disclosed generally includes inclined rafters 24, beams 26, vertical and diagonal bracing members 28 and may include structural reinforcing members 30, commonly collectively referred to as "planks." The planks (24 to 30) are generally made of wood or steel arranged in a triangulated pattern and secured by truss connector plates 32 which are sometimes referred to as nail plates. The connector plates 32 generally include a plurality of integrally struck sharp tangs (not shown) extending perpendicular to the connector plates or nails may be used. Floor trusses (not shown) include parallel upper and lower chords and bracing members or runners arranged in a triangulated pattern between the chords and secured by connector plates. As will be understood, however, the configuration of the truss (roof or floor) does not form a part of this invention and the method of this invention may be used to assemble any truss design, although the method of this invention will be particularly useful for assembling roof trusses including complex roof trusses.

Figure 4:
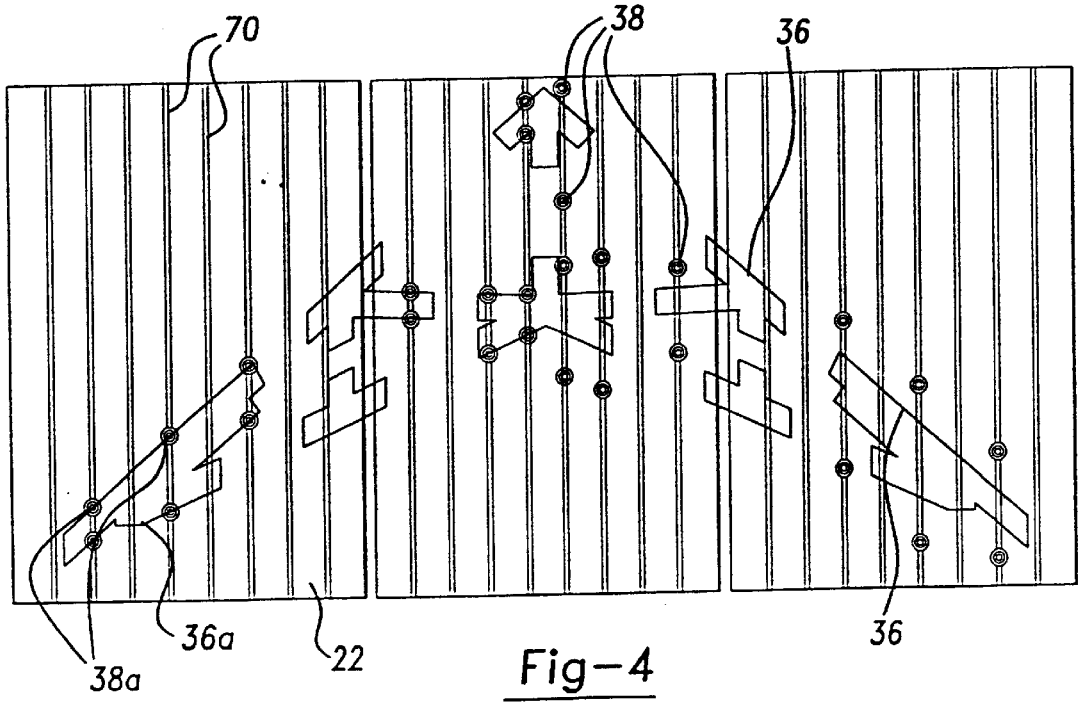
FIG. 4 is a top view of a projected laser image illustrating one step in the method of this invention.

As will be understood by those skilled in laser projection or laser template assembly methods, such methods comprise projecting a laser generated outline or "template" of the components to be assembled on work surface, such as truss planks and/or connector plates of a truss or plys of an aircraft assembly. The laser generated template is of the same size and configuration as the component in the assembled position. The component is then oriented and laid over the laser template and affixed to other components by mechanical fasteners, such as truss connector plates, adhesive, etc. Using this method for assembly of components on jig assembly tables is not preferred, however, because it is difficult to align the jigs with a laser template of the component and the laser template is generally partially hidden from view. The first step in the method of assembly of this invention is to project an enlarged laser generated outline 36 of at least a portion of the components to be assembled on the work surface 22 as shown in FIG. 4. The enlarged laser outline is described more fully hereinbelow. The second step is to align the jigs 38 with the laser outline 36. As shown at the left in FIG. 4, the jigs 38*a* are aligned with the laser outline 36*a*. Some of the remaining jigs 38 are aligned with the laser outline and some are not yet aligned.

Figure 5:
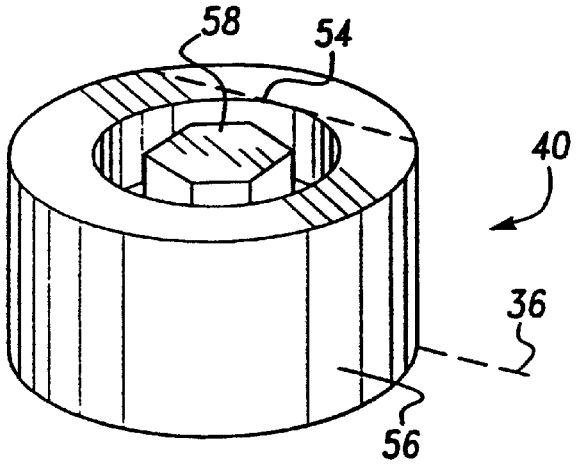
FIG. 5 is a top perspective view of an alternative embodiment of the jigs shown in FIGS. 1–3.
Figure 6:
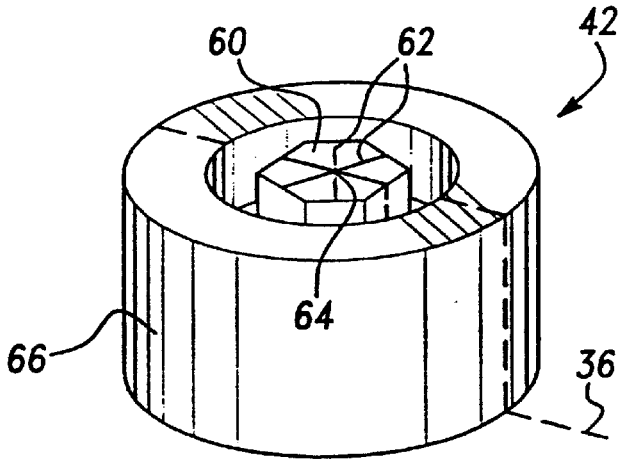
FIG. 6 is a top perspective view of an alternative embodiment of the jig illustrated in FIG. 5.

The jigs have been specifically adapted to the method of this invention although the use of jigs of this general type is known. This application discloses three alternative jig embodiments, including the jigs 38 in FIGS. 1 to 4, the jig design 40 shown in FIG. 5 and the jig design 42 shown in FIG. 6. The jig 36 best shown in FIG. 3 includes opposed slots 44 which are utilized for fixing the jigs 38 relative to the work surface 22 as discussed below. Each of the jigs 38 include a top surface 46 spaced above the work surface 22 having laser alignment indicia 48 spaced a predetermined distance from a side surface 50. In the embodiment of the jigs shown in FIG. 3, the laser alignment indicia 48 comprises crossed scribes marking the center point of the generally cylindrical jigs 38. In the embodiment of the jig 40 shown in FIG. 5, the laser alignment indicia may be the inside circular edge 54 of the annular top portion of the generally cylindrical body of the jig 40, which is always spaced a predetermined distance from the cylindrical side face 56. The center hexagonal portion 58 is used to fix the jig on the work surface as discussed below. In the embodiment of the jig 42 shown in FIG. 6, the top of the central hexagonal post 60 is marked with three scribes 62 marking the center 64 of the cylindrical body of the jig 42, which is also spaced a predetermined distance from the cylindrical side surface 66. As will be understood, the "top" surface of the hexagonal portions 58 in FIG. 5, 60 in FIG. 6 and 46 in FIG. 3 may actually be higher or lower than the upper most top surface of the jig.

As can now be described, the enlarged laser outline 36 projected on the work surface is spaced laterally a distance equal to the distance between the laser alignment indicia (the center of the crossed scribes 52 in FIG. 3, 54 in FIG. 5 and 64 in FIG. 6) and the side surface (50 in FIG. 3, 56 in FIG. 5 and 66 in FIG. 6) of the jigs (38 in FIG. 3, 40 in FIG. 5 and 42 in FIG. 6) such that the side surfaces of the jigs in combination define the actual outline of the components to be assembled. As will be understood, the enlarged laser projected outline 36 may be spaced laterally on one or both sides of the component to be assembled depending on the placement of the jigs and may define a complete outline of the components. The laser outline 36 is also generated or "spaced" above the plane of the work surface 22 a distance equal to the distance between the work surface 22 and the laser alignment indicia.

Thus, the jigs (38 in FIGS. 1 to 4, 40 in FIG. 5 and 42 in FIG. 6) may be very easily and accurately aligned with the enlarged laser outline 36 of the components or parts to be assembled. In a conventional jig set-up table 22 disclosed and discussed above, the work surface 22 includes a plurality of spaced parallel guides 70 and the jigs are moveable in parallel relation along the guides and fixable relative to the work surface 22. In the disclosed embodiment of the work surface or work table 22, the guides are parallel channels 70 as best shown in FIG. 3. The jigs 38, 40 and 42 each include a lower generally cylindrical portion (not shown) which is received in the channels 70 and a locking mechanism (not shown) is located at the lower end of the jig which fixes the jigs relative to the work surface 22. Truss jig set-up tables of this type are available from MiTek Industries. Alternative designs of truss jig set-up tables are also commercially available which include spaced parallel index rails and the jigs are slidably mounted on the rails for adjustment of the jigs. In either event, the jigs must be very accurately placed by measurement or using a scale without reference to an outline of the truss components to be assembled. The general construction of jig set-up tables does not, however, form a part of this invention and therefore no further disclosure is required for a person of ordinary skill in the art.

Figure 2:
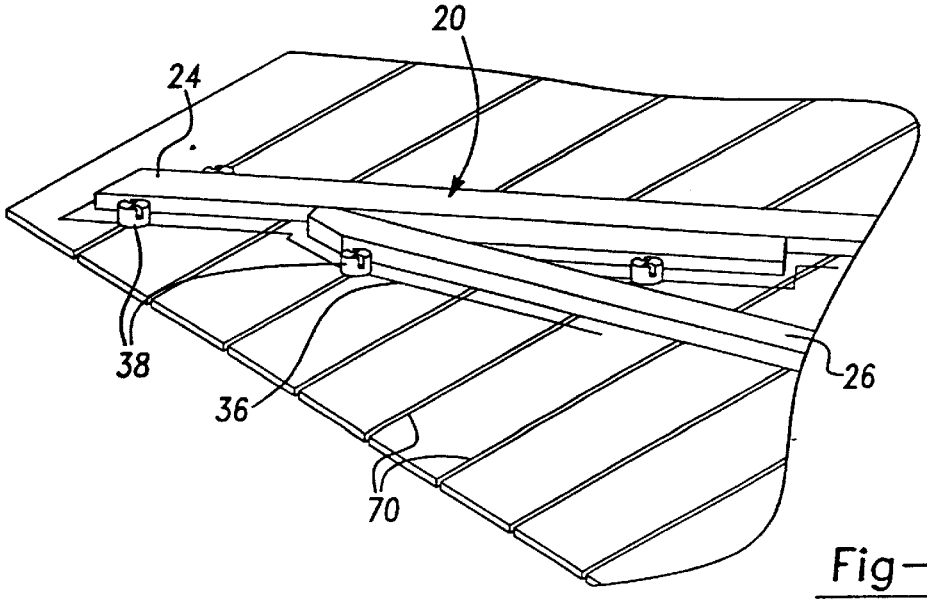
FIG. 2 is an enlarged perspective view of a portion of the truss assembly shown in FIG. 1.
Figure 3:
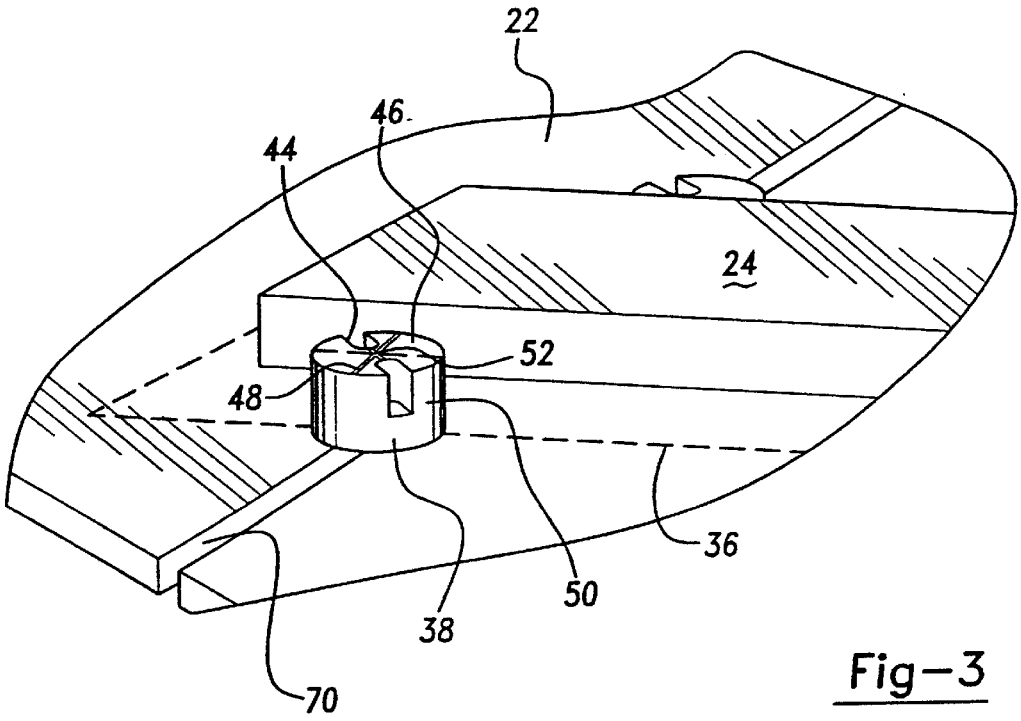
FIG. 3 is an enlarged view of a portion of FIG. 2.

The next step in the assembly method of this invention comprises orienting and placing the components of the parts to be assembled between the jigs as shown in FIGS. 1 to 3. The components in a roof truss of the type disclosed comprise the planks (24 to 30) and the truss connectors plates 32 as already described above. This task is greatly simplified using the method of assembly of this invention by the enlarged laser outline 36 as shown in FIG. 4, which significantly reduces the chance of error. The truss planks are then assembled by attachment of the truss connector plates 32 by conventional methods.

As described above, the enlarged laser outline 36 is generated by a laser scanner or laser projector 72 which is operable connected to a computer 74. The data necessary to generate the enlarged laser outline 36 is stored in the computer 74 which also controls the operation of the laser scanner 72. As will be understood by those skilled in laser projection, particular laser template assembly systems, sensors or retro-reflective elements (not shown) are normally placed on the work surface 22 or a predetermined distance from the work surface to control the precise location of the projected enlarged laser outline on the work surface 22. The laser scanner 72 may be suspended from the ceiling for example over the work surface for projection of the laser outline on the work surface. Laser template assembly systems of the type described are available from Virtek Vision Corp., the assignee of the present invention.

In summary, the method of assembly of this invention comprises projecting an enlarged laser outline 36 of at least a portion of the components to be assembled on the work surface 22 as best shown in FIG. 4. The laser outline is spaced laterally from an outline or template of the components of the assembly a distance equal to the distance between the laser alignment indicia and the side surface of the assembly jigs. In the jig 38, best shown in FIG. 3, the indicia comprises the center 52 of the cylindrical jig 38, which is spaced laterally a predetermined distance from the cylindrical side surface 50. The method then includes moving the jigs 38 on the work surface 22 to align the indicia 52 with the laser image as best shown in FIG. 3. The side surfaces 50 of the jigs now define in combination an outline of the components to be assembled. That is, a line drawn between the inside side cylindrical surfaces 50 of the jigs define an outline of the components. The components are then assembled on the work surface 22 by orienting the components and placing the components on the work surface with the side surfaces of the components in generally abutting relation with the side surfaces 50 of the jigs as shown in FIGS. 1 to 3. Finally, the components may be interconnected, completing the assembly. In the disclosed method of assembling a truss, the planks (24 to 30) are interconnected by truss connector plates 32 simply by driving the plates into the adjoining top surfaces of the planks. Connector plates are generally attached to both the top and bottom surfaces of the planks.

As will be understood by those skilled in the art, various modifications may be made to the method of assembly of this invention, particularly where the method of assembly is used for assembling the components of other structures. Although generally cylindrical jigs are preferred for simplicity of design and alignment, other configurations may be used, provided the jigs include an indicia on a top surface of the jigs which are spaced a predetermined distance from a side surface for accurate alignment of the jigs on the work surface 22. The side surface may also be flat wherein, for example, the side surface is polygonal, although a circular or cylindrical surface is generally simpler for set-up. Further, as described, the configuration of the jig set-up table may be any suitable design including the types described and various laser projection systems may be utilized.

What is claimed is:

1. A method of assembling the components of an assembly on a work surface using a laser imaging system, said work surface including a plurality of jigs moveable on said work surface and fixable to said work surface to define the relative positions of said assembly components, and said jigs each including a laser alignment indicia on a top surface of said jigs spaced above said work surface, said indicia spaced a predetermined distance from a side surface of said jigs, and said side surfaces of said jigs defining said relative positions of said components of said assembly when assembled on said work surface, said method comprising the following steps:

projecting a laser image on said work surface, said laser image including an enlarged outline of at least a portion of said components of said assembly in the desired location spaced laterally from an outline of said components a distance equal to said predetermined distance from said indicia to said side surface of said jigs and spaced vertically from said work surface a distance equal to the distance between said work surface and said top surface of said jigs;

moving a plurality of jigs on said work surface to align said laser alignment indicia on said top surface of said jigs with said laser image enlarged outline and fixing said jigs on said work surface, wherein said side surfaces of said jigs in combination define an outline of said components of said assembly in the desired assembled position; and placing said components of said assembly on said work surface adjacent said side surfaces of said jigs and assembling said components in said assembly.

2. The method of assembling the components of an assembly on a work surface as defined in claim 1, wherein said components comprise a plurality of truss planks and connector plates for assembling a truss of a predetermined design, and said work surface having a plurality of generally equally spaced parallel guides, said jigs mounted on said parallel guides for movement along said guides and fixable relative to said work surface, said method including projecting a laser image on said work surface crossing said parallel guides, moving said jigs in parallel relation on said guides to align said laser alignment indicia on said top surfaces of said jigs with said projected laser image enlarged outline and fixing said jigs relative to said work surfaces, then assembling said components of said truss on said work surface in abutting engagement with said side surface of said jigs, then assembling said planks by interconnecting said planks with said truss plates.

3. The method of assembling the components of an assembly on a work surface using a laser imaging system as defined in claim 1, wherein said side surface of each of said jigs is cylindrical and said indicia marking an indicia point on said top surface of said jigs coincident with the center axis of said cylindrical side surface of said jigs, such that said predetermined distance between said point and said side surface is equal to the radius of said cylindrical side surface of said jigs, said method including moving said plurality of jigs on said work surface to align said indicia point on said top surface of said jigs with said laser image enlarged outline and fixing said jigs on said work surface, said outline of components of said assembly then defined by the inside tangents of said cylindrical side surfaces of said jigs, said method then including placing said components on said work surface with an outer surface of said components abutting said cylindrical side surfaces of said jigs and assembling said components.

4. The method of assembling the components of an assembly on a work surface using a laser imaging system as defined in claim 3, wherein said indicia point comprises the intersection of crossed scribed on said top surface of said jigs, wherein said method includes moving said plurality of jigs on said work surface to align said intersection of crossed scribes with said laser image enlarged outline of said components.

5. The method of assembling the components of an assembly on a work surface using a laser imaging system as defined in claim 1, wherein said side surface of each of said jigs is cylindrical and said indicia is an edge on said top surface of said jigs, said method including moving said plurality of jigs on said work surface to align said edge on said top surface of said jigs with said laser imaging enlarged outline and fixing said jigs on said work surface, said outline of components then defined by an inside tangent of said cylindrical side surfaces of said jigs, then placing said components on said work surface with an outer surface of said components abutting said cylindrical side surfaces of said jigs and assembling said components.

6. The method of assembling the components of any assembly on a work surface using a laser imaging system as defined in claim 5, wherein said top surface of each of said jigs include an annular surface having an outer surface coincident with said cylindrical outer surface of said jigs and a coaxially aligned cylindrical inner surface, said indicia edge then defined by a tangent to said cylindrical inner surface and said method including moving said plurality of jigs on said work surface to align said cylindrical inner surfaces of said annular top surface of said jigs with said laser image enlarged outline and fixing said jigs on said work surface.

7. A method of assembling the components of a truss on a work surface using a laser image alignment system, said components of said truss comprising a plurality of planks and truss connector plates, said work surface including a plurality of jigs moveable on said work surface and fixable relative to said work surface, said jigs each having a side surface, said side surfaces of said jigs defining in combination the relative positions of said components of said truss on said work surface and said jigs each including a laser alignment indicia on a top surface spaced above said work surface and said laser alignment indicia spaced a predetermined distance from said side surface of said jigs, said method comprising the following steps:

projecting a laser image on said work surface, said laser image including an enlarged outline of at least a portion of said components in a predetermined orientation of said truss spaced laterally from an outline of said components a distance equal to said predetermined distance from said laser alignment indicia to said side surface of said jigs and spaced vertically from said work surface a distance equal to the distance between said work surface and said top surface of said jigs;

moving a plurality of jigs on said work surface to align said laser alignment indicia of said jigs with said laser image enlarged outline and fixing said jigs relative to said work surface, wherein said side surfaces of said jigs define in combination an outline of said components of said truss in said predetermined orientation of said truss; and placing said components of said truss on said work surface in generally abutting relation with said side surfaces of said jigs and assembling said components of said truss by interconnecting said planks in said predetermined orientation with said truss connector plates.

8. The method of assembling the components of a truss on a work surface as defined in claim 7, wherein said work surface includes a plurality of spaced generally parallel guides and said jigs mounted on said guides for movement in parallel relation along said guides and fixable relative to said work surface, said method comprising projecting an enlarged laser outline of at least a portion of said components of said truss on said work surface crossing said guides, then moving said jigs in generally parallel relation along said guides to align said laser alignment indicia on said top surfaces of said jigs with said laser image enlarged outline, then fixing said jigs relative to said work surface, then assembling said components of said truss on said work surface in abutting relation with said side surfaces of said jigs and assembling said components of said truss by interconnecting said planks with said truss connector plates.

9. The method of assembling the components of truss on a work surface as defined in claim 8, wherein said method includes projecting a laser image on said work surface of an enlarged outline of a portion of said planks of said truss in said predetermined orientation.

10. The method of assembling the components of a truss on a work surface as defined in claim 8, wherein said guides on said work surface comprise a plurality of generally parallel channels, said jigs each including a portion received in one of said channels and moveable in parallel relation along said channels, said method including moving said jigs along said channels in said work surface to align said indicia on said top surface of said jigs with said laser image and then fixing said jigs relative to said work surface.

11. The method of assembling the components of a truss on a work surface as defined in claim 7, wherein said side surface of each of said jigs is cylindrical and said indicia marking an indicia point on said top surface of said jigs coincident with the center axis of said cylindrical side surface of said jigs, such that said predetermined distance is equal to the radius of said cylindrical side surface of said jigs, said method including moving said plurality of jigs on said work surface to align said indicia point on said top surface of said jigs with said laser image enlarged outline and fixing said jigs relative to said work surface, wherein a tangent to said cylindrical side surfaces of said jigs define in combination an outline of said components of said truss in said predetermined orientation of said truss, placing said components of said truss on said work surface in generally abutting relation with said cylindrical side surfaces of said jigs and assembling said components of said truss by interconnecting said planks in said predetermined orientation with said truss connector plates.

12. The method of assembling components of a truss on a work surface as defined in claim 7, wherein said side surface of each of said jigs is cylindrical and said indicia is an indicia edge on said top surface of said jigs, said method including moving said plurality of jigs on said work surface to align said indicia edge of said jigs with said laser image enlarged outline and fixing said jigs relative to said work surface, wherein said side cylindrical surfaces of said jigs define in combination an outline of said components of said truss in said predetermined orientation of said truss, placing said components of said truss on said work surface in generally abutting relation with said cylindrical side surfaces of said jigs and assembling said components of said truss by interconnecting said planks in said predetermined orientation with said truss connector plates.

* * * * *